US006361931B1

(12) United States Patent
Lussier et al.

(10) Patent No.: US 6,361,931 B1
(45) Date of Patent: Mar. 26, 2002

(54) SILVER HALIDE PHOTOGRAPHIC ELEMENT, IMAGING PROCESS, AND COMPOUND

(75) Inventors: Barbara B. Lussier, Rochester; Michael J. Proseus, Webster; Brian Thomas, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/747,700

(22) Filed: Dec. 22, 2000

(51) Int. Cl.[7] ..... G03C 1/08; G03C 7/26; G03C 7/32

(52) U.S. Cl. ..... 430/557; 430/389

(58) Field of Search ..... 430/389, 557

(56) References Cited

U.S. PATENT DOCUMENTS

| | | | | |
|---|---|---|---|---|
| 5,677,114 A | | 10/1997 | Lussier et al. | |
| 6,071,683 A | | 6/2000 | Goddard et al. | |
| 6,130,032 A | * | 10/2000 | Tang et al. | 430/557 |

FOREIGN PATENT DOCUMENTS

| | | | |
|---|---|---|---|
| JP | 1-180545 | * | 7/1989 |
| JP | 1-180546 | * | 7/1989 |
| JP | 1-180547 | | 7/1989 |

OTHER PUBLICATIONS

JP Abstract 1–180547.

* cited by examiner

*Primary Examiner*—Geraldine Letscher

(74) *Attorney, Agent, or Firm*—Arthur E. Kluegel

(57) ABSTRACT

Disclosed is a color photographic element comprising a yellow dye-forming coupler having formula I:

I wherein:

B is a substituent containing 6 or more carbon atoms;

L is a linking group bonded to the anilide ring by a carbon, sulfur, or oxygen atom;

R is a substituent and n is 0–3;

X is a solubilizing group containing an acidic proton;

Y is a substituent; and

Z is selected from the group consisting of H, chloro, an alkoxy group and an aryloxy group.

The element provides an improved combination of reactivity and stability.

20 Claims, No Drawings

SILVER HALIDE PHOTOGRAPHIC ELEMENT, IMAGING PROCESS, AND COMPOUND

FIELD OF THE INVENTION

This invention relates to a silver halide photographic element containing an acylacetanilide yellow dye-forming coupler having a phenoxy coupling-off group and an anilide ring bearing a certain para substituent group.

BACKGROUND OF THE INVENTION

Color silver halide photographic elements are well-known in the art. They typically include one or more light-sensitive silver halide emulsion layers sensitive to blue light that contain a yellow dye-forming coupler capable of producing a yellow image dye upon development. Most common among the suitable yellow dye-forming couplers are those based on acylacetanilide compounds. Typically the compounds are pivaloyl acetanilides.

U.S. Pat. No. 5,667,114 of Lussier et al., discloses a certain pivaloyl acetanilide coupler that contains a particular phenoxy group in the anilide ballast and provides desirable dye stability. U.S. Pat. No. 6,071,683 of Goddard et al., discloses a certain pivaloyl acetanilide coupler that contains a particular oxy group on the anilide ring of the ballast and provides desirable dye light stability.

While such compounds have been useful for providing yellow dye of the desirable density and hue needed for color imaging, further improvements in the photographic properties are needed.

It is a problem to be solved to provide a photographic element that provides a yellow dye-forming coupler that has an improved combination of reactivity, and dye dark stability.

SUMMARY OF THE INVENTION

The invention provides a color photographic element comprising a yellow dye-forming coupler having formula I:

I

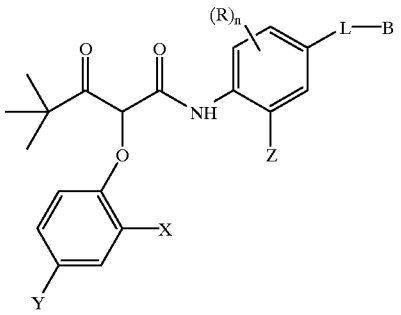

wherein:

B is a substituent containing 6 or more carbon atoms;

L is a linking group bonded to the anilide ring by a carbon, sulfur, or oxygen atom;

R is a substituent and n is 0–3;

X is a solubilizing group containing an acidic proton;

Y is a substituent; and

Z is selected from the group consisting of H, chloro, an alkoxy group and an aryloxy group.

The invention also provides a coupler compound, a packaged element, and a method of forming an image in an element of the invention.

The element provides an improved combination of reactivity and stability.

DETAILED DESCRIPTION OF THE INVENTION

The invention is generally as described above. In formula I of the invention, L is a linking group employing a carbon, sulfur, or oxygen atom bonded to the anilide ring. Suitable carbon atoms for this purpose are an acyl group such as alkylacyl, an ester (COO—) group or a carbamoyl group. Examples of the use of a sulfur atom are a sulfonyl, oxysulfonyl, sulfamoyl, or sulfoxy groups. The ester group is most conveniently used.

The group Z is conveniently represented by an alkoxy or chloro group. B is a group containing at least 6 carbon atoms and usually 8 or more. This group functions in part to help ballast the coupler so that it remains in the organic phase during processing. R is any substituent group as defined hereafter and is optional as indicted by the value of n ranging from 0 to 3.

The phenoxy group contains substituents X and Y. X is in the ortho position and contains an acidic proton that is believed useful to enhance reactivity. Suitable examples are carbonamido, sulfonamido, and carboxylic acid groups. The carbonamido and sulfonamido groups are conveniently employed. Y is desirably an electron withdrawing group. Such groups are defined as those having a Hammett's sigma para value of 0 or greater. Values may be ascertained from available sources such as *Substituent Constants for Correlation Analysis in Chemistry and Biology*, Hansch and Leo, Wiley, New York,(1979). Thus, the groups desired for Y are electron withdrawing. Suitable Y groups are —H, —CN, —CON<, —$SO_2$N<, —$SO_2$OH, —$SO_2$—, and —COOH groups. Sulfone, carboxylic acid, arylsulfonyl, and carbamoyl groups are conveniently used.

The following are the formulas for comparison couplers (YC) used in the examples or for examples of couplers (Y) useful in the invention.

YC1
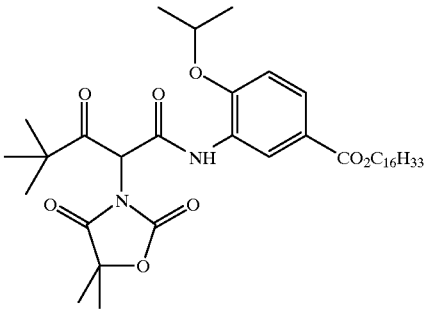
YC2
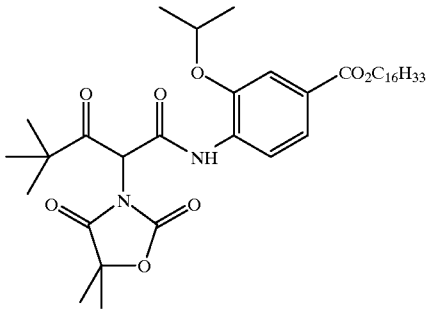
YC3
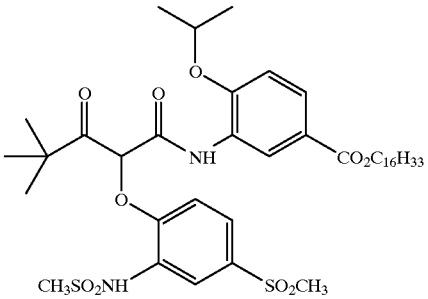
Y4
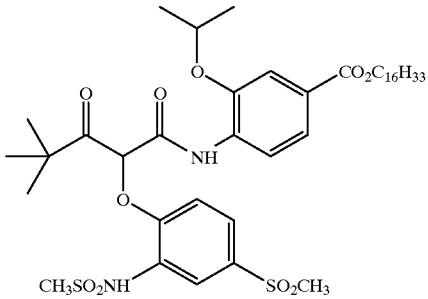
Y5
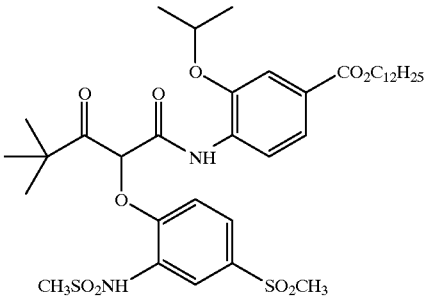
Y6
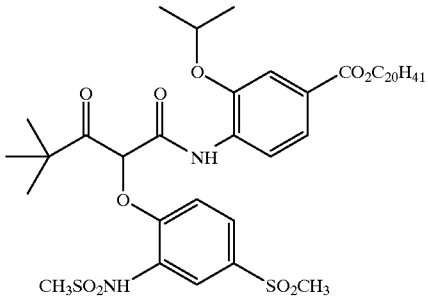
YC7
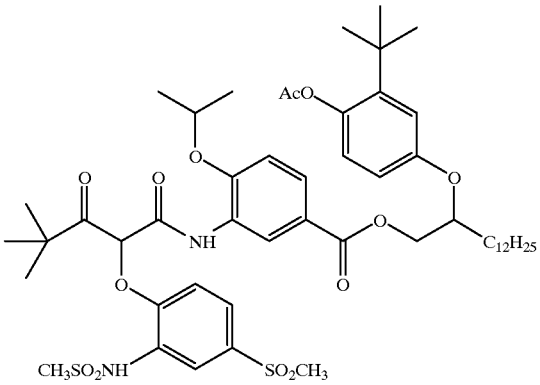
Y8
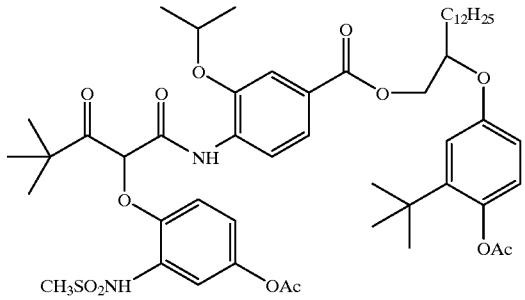

-continued
Y9
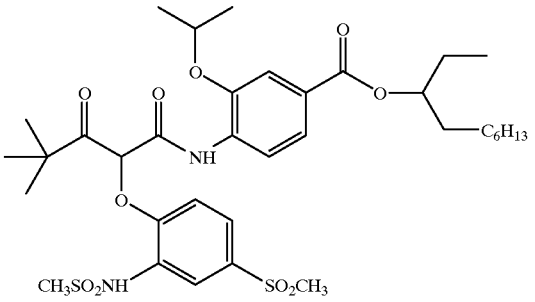
Y10
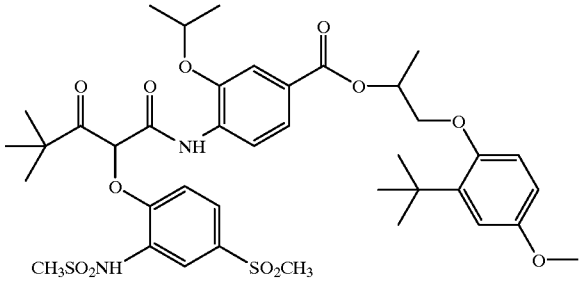
YC11
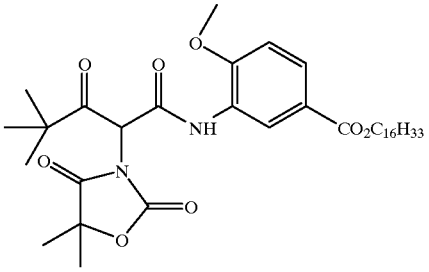
Y12
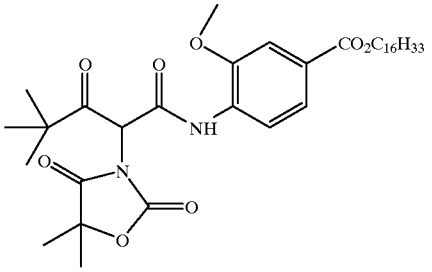
YC13
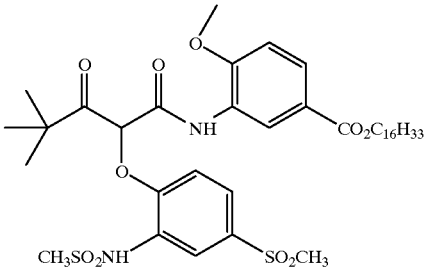
Y14
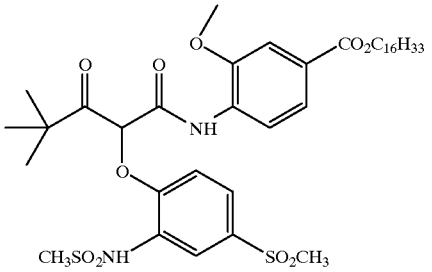
Y15
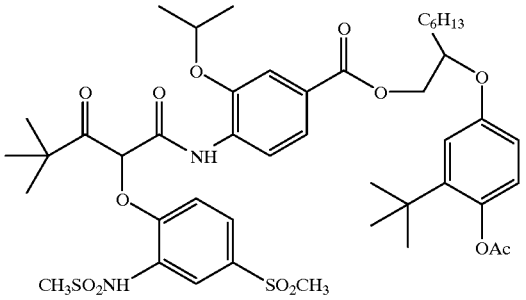
Y16
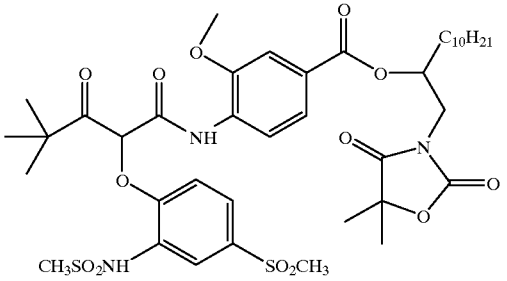
Y17
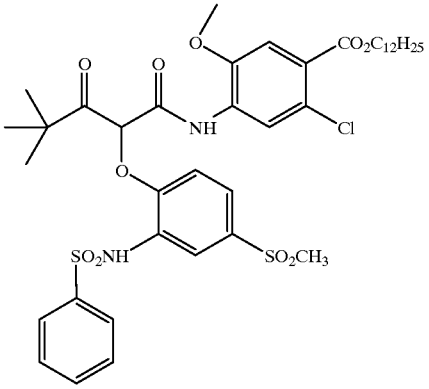
Y18
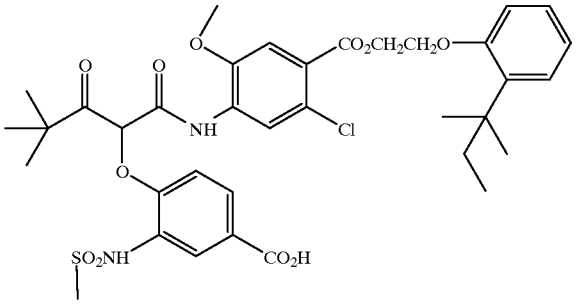

-continued

Y19

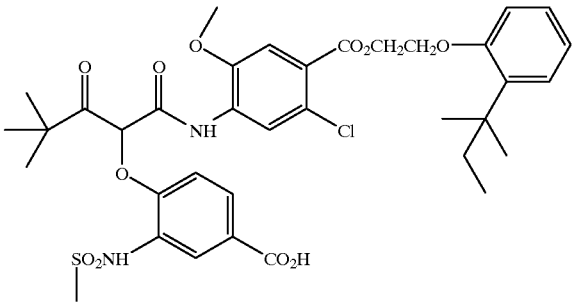

Y20

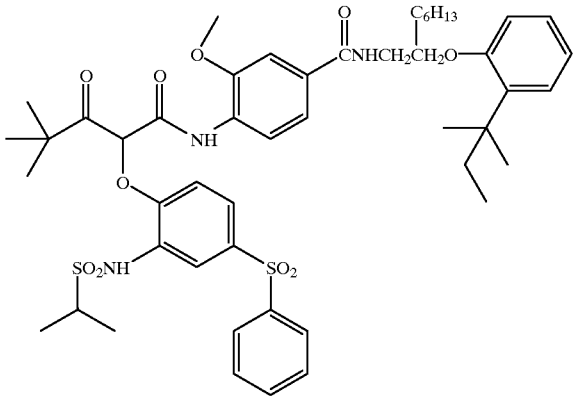

Y21

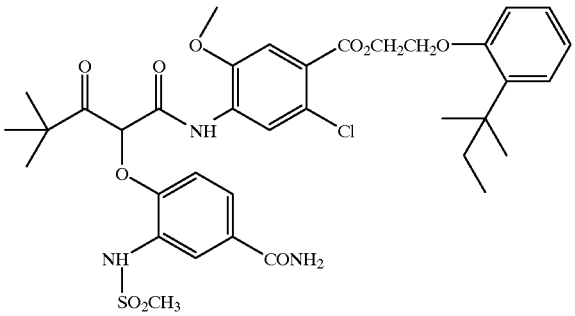

Y22

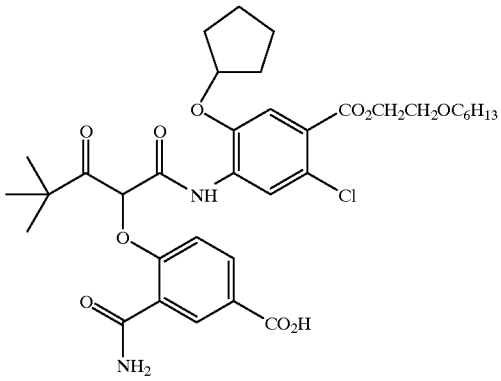

YC23

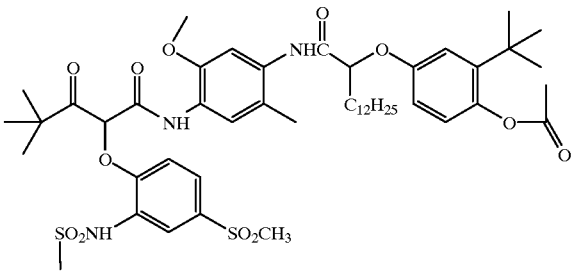

YC24

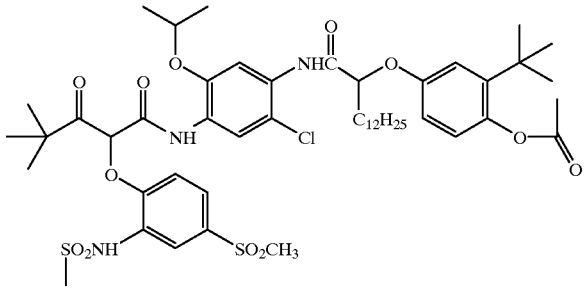

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfmyl, octylsulfinyl, 2-ethylhexylsulfinyl, dodecylsulfmyl, hexadecylsulfinyl, phenylsulfinyl, 4-nonylphenylsulfinyl, and p-tolylsulfmyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials useful in the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777, and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. No. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. No. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat.

No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019,492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411, 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

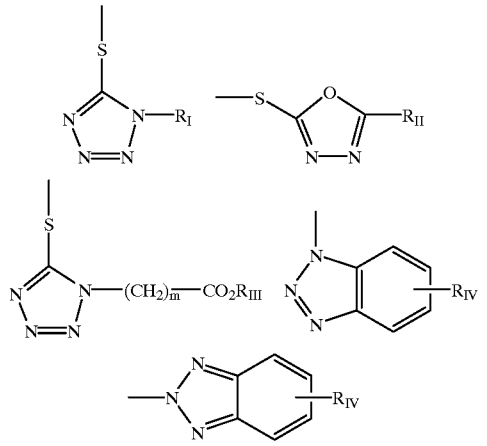

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and Rv is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

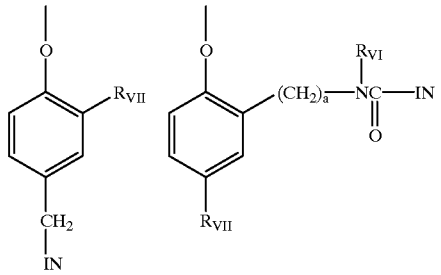

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

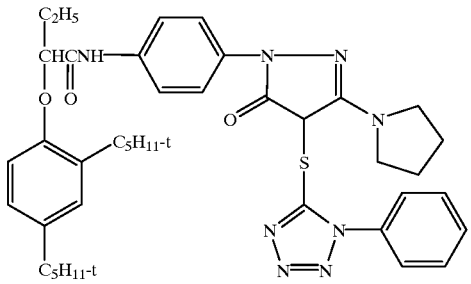

D2

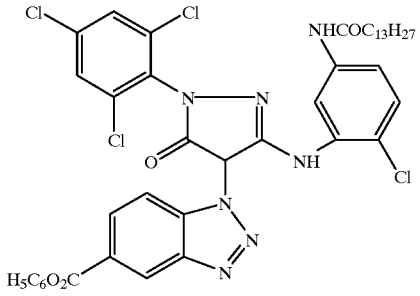

-continued

D3

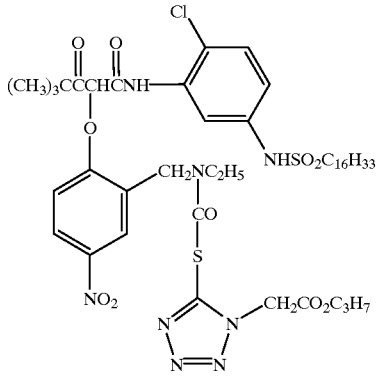

D4

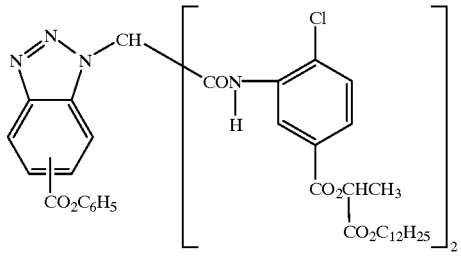

D5

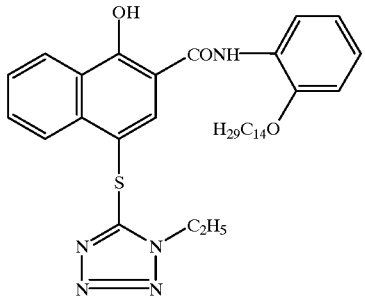

D6

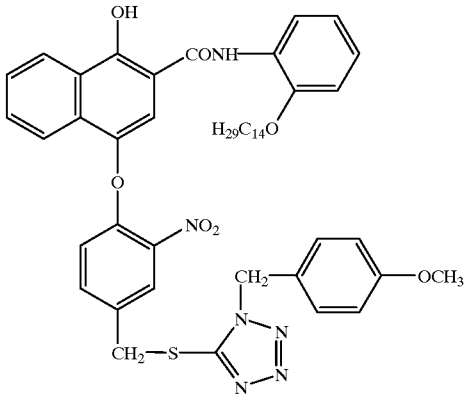

-continued
D7
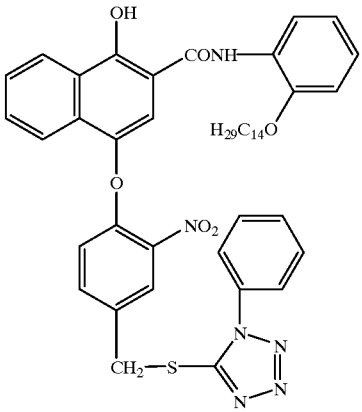
D8
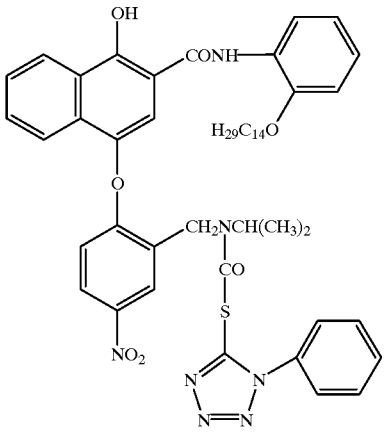
D9
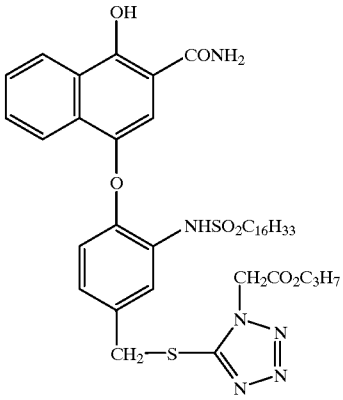
-continued
D10
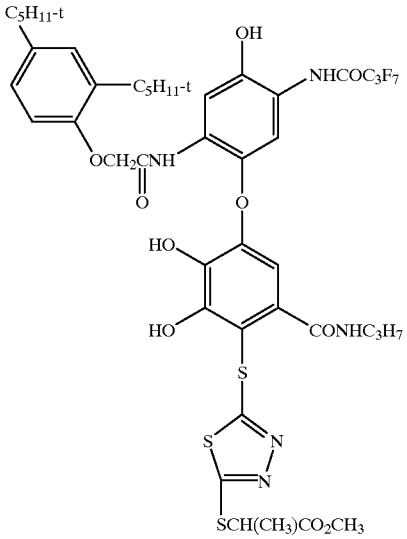
D11
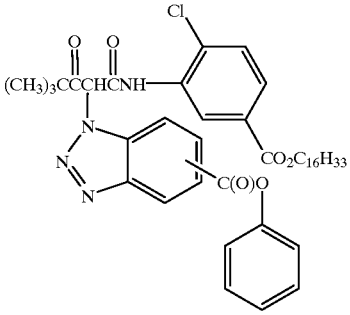
D12
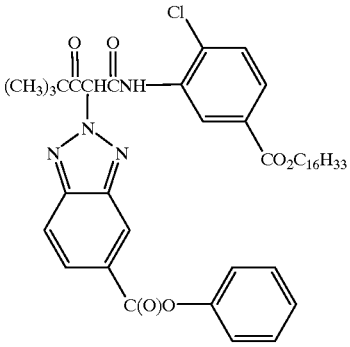
It is also contemplated that the present invention may be employed to obtain reflection color prints as described in

*Research Disclosure*, November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072, 634; 90-077,822; 90-078,229; 90-078,230; 90-079,336; 90-079,337; 90-079,338; 90-079,690; 90-079,691; 90-080, 487; 90-080,488; 90-080,489; 90-080,490; 90-080,491; 90-080,492; 90-080,494; 90-085,928; 90-086,669; 90-086, 670; 90-087,360; 90-087,361; 90-087,362; 90-087,363; 90-087,364; 90-088,097; 90-093,662; 90-093,663; 90-093, 664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and 5,252,453, Black et al U.S. Pat. Nos. 5,219, 720 and 5,334,495, Delton U.S. Pat. Nos. 5,310,644, 5,372, 927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region bf the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS

4-Nitro-3-hydroxy-ethylbenzoate

To a solution of 4-nitro-3-hydroxybenzoic acid (1.2 g, 0.056 mol) in ethanol (10 mL) was added concentrated sulfuric acid (2 mL). The mixture was heated to reflux for 3 hours. The solvent was reduced in volume to 2.0 mL, then the mixture was cooled in an ice bath. The orange crystals, which formed upon cooling, were filtered off and rinsed with water (2×50 mL). The crystals were dried to give 11.2 g (95%) 4-nitro-3-hydroxy-ethylbenzoate. 1H NMR: d 1.4 (t, 3H), 4.4 (q, 2H), 7.6 (d, 1H), 7.8 (s, 1H), 8.3 (d, 1H), 10.4 (br, 1H). Ms: $ES^-$ 210, $ES^+$ 212.

4-Nitro-3-isopropoxy-ethylbenzoate

To a solution of 4-nitro-3-hydroxy-ethylbenzoate (10.0 g, 0.055 mol) in DMF (100 mL) was added 2-bromopropane (6.77 g, 0.11 mol) and potassium carbonate (7.6 g, 0.055 mol). The mixture was stirred at 40° C. for 5 hours. The mixture was cooled to room temperature and poured into 0.1 M HCl (500 mL). The aqueous mixture was extracted with EtOAc (3×150 mL). The organic extracts were combined and washed with water to remove excess DMF. The volume of ethyl acetate was reduced to 20 mL. The mixture was then cooled in an ice bath. Long orange crystals formed, which were collected and dried under vacuum to yield 12.4 g (88%) of 4-nitro-3-isopropoxyethylbenzoate. MS ES− 253, ES+ 255

4-Nitro-3-isopropoxybenzoic acid

To a solution of 4-nitro-3-isopropoxy-ethylbenzoate (11.85 g, 0.047 mol) in ethanol (200 mL) was added a solution of potassium hydroxide (2.6 g, 0.047 mol) in water (5 mL). The reaction mixture was heated to reflux for 2 hours. The ethanol volume was reduced to 100 mL and the mixture then poured into 1 N HCl (100 mL). The crystals that precipitated, were filtered off and dried in a vacuum oven to yield 9.35 g (88%) of 4-nitro-3-isopropoxybenzoic acid. MS $ES^-$ 225, $ES^+$ 223.

4-Nitro-3-isopropoxy-hexadecylbenzoate

The 4-nitro-3-isopropoxybenzoic acid (15.0 g, 0.067 mol) was taken up in dichloromethane (100 mnL) and oxalyl chloride (13 mL, 0.2 mol) and 1 drop DMF added. The mixture was stirred for 2 hours at room temperature. The solvent was removed in vacuo. The residue was triturated with toluene and then the toluene was distilled off. The residue was submitted to high vacuum for one hour. The oil was redissolved in dry acetonitrile (75 mL) and hexadecanol (16.15 g, 0.067 mol) and diisopropylethylamine (8.6 g, 0.067 mol) added. The reaction mixture was stirred for 2 hours at 40° C. The acetonitrile was removed in vacuo and the residue was submitted to standard, aqueous, acidic workup (as above). The organics were recrystallized from ligroin to give a light tan solid (24.7 g, 82%) of 4-nitro-3-isopropoxyhexadecylbenzoate. MS $ES^-$ 449.

4-Amino-3-isopropoxy-hexadecylbenzoate

A solution of 4-nitro-3-isopropoxyhexadecylbenzoate (19 g, 0.042 mol) and Pd/C (1.9 g) in ethanol (200 mL) and DMF (30 mL) was catalytically reduced under hydrogen 3.65 kg/cm$^2$ (50 psi) for 5 hours. The catalyst was filtered off and the ethanol removed in vacuo. The resulting DMF solution was poured into water (300 mL) and extracted with EtOAc (3×150 mL). The EtOAc extracts were washed well with water to remove traces of DMF, then dried over $MgSO_4$, filtered and reduced to a tan solid 17.6 g, (100% crude recovery), suitably pure for further use. MS ES− 418.

4-(4,4-Dimethyl-3-oxovaleramido)-3-isopropoxy-hexadecylbenzoate

A solution of 4-amino-3-isopropoxyhexadecylbenzoate (17.6 g, 0.049 mol) and methyl-4,4,-dimethyl-3-oxovalerate (6.6 g, 0.042 mol) in toluene (100 mL) with a catalytic amount of pTSA was heated to reflux. The methanol was driven off and collected by a Dean Stark trap. When the reaction was done, the toluene was reduced to minimum volume, at which point, crystals began to form. The solid was collected and recrystallized from acetonitrile to give an off-white solid, 20 g, (88%) of 4-(4,4-dimethyl-3-oxovaleramido)-3-isopropoxyhexadecylbenzoate. MS ES− 544, ES+ 546.

4-(4,4-Dimethyl-3-oxo-2-chlorovaleramido)-3-isopropoxy-hexadecylbenzoate

To a solution of 4-(4,4-dimethyl-3-oxovaleramido)-3-isopropoxyhexadecylbenzoate (19.1 g, 0.036 mol) in dichloromethane (75 mL) was added sulfuryl chloride (4.73 g, 0.03 mol). The mixture was stirred at room temperature for 3 hours. The solvent was removed in vacuo to leave a white waxy solid, 20.27 g, of 4-(4,4-dimethyl-3-oxo-2-chlorovaleramido)-3-isopropoxyhexadecylbenzoate. The solid was recrystallized from acetonitrile to yield 18.8 g (90%) of the product. MS ES− 578

SYNTHESIS OF Y4

To a solution of 4-(4,4-dimethyl-3-oxo-2-chlorovaleramido)-3-isopropoxyhexadecylbenzoate (4.0 g, 6.9 mmol) in tetrahydrofuran (50 mL) was added 2-methylsulfonamido-4-methylsulfonyl-phenol (1.89g, 7.1 mmol) and diisopropylethylamine (0.9 g, 6.9 mmol). The reaction mixture was stirred at 50° C. for 3 hours, then submitted to standard aqueous, acidic workup. The crude product was chromatographed on silica gel with dichloromethane/ethyl acetate as eluent. The product was isolated as a colorless solid in 85% yield. MS ES− 808, ES+ 810

SYNTHESIS OF Y8

4-Nitro-3-isopropoxy-(2-(3-tert-butyl-4-acetoxy-phenoxy)tetradecyl)benzoate

The 4-nitro-3-isopropoxybenzoic acid (15.0 g, 0.067 mol) was taken up in dichloromethane (100 mL) and oxalyl chloride (13 mL, 0.2 mol) and 1 drop DMF added. The mixture stirred for 2 hours at room temperature. The solvent was removed in vacuo. The residue was triturated with toluene and then the toluene was distilled off. The residue was submitted to high vacuum for one hour. The oil was redissolved in dry acetonitrile (75 mL) and 2-(3-tert-butyl-4-acetoxy)-1-tetradecanol (28.2 g, 0.067 mol) and diisopropylethylamine (8.6 g, 0.067 mol) added. The reaction mixture was stirred for 2 hours at 40° C. The acetonitrile was removed in vacuo and the residue was submitted to standard, aqueous, acidic workup (as above). The organic extracts were reduced to an oil and chromatographed on silica gel with ligroin/EtOAc (90:10) to yield the desired product, 37.8g, (90%). MS ES− 626

4-Amino-3-isopropoxy-(2-(3-tert-butyl-4-acetoxy-phenoxy)-tetradecyl)benzoate 4-nitro-3-isopropoxy-(2-(3-tert-butyl-4-acetoxy-phenoxy)-tetradecyl)benzoate (18.0 g, 0.029 mol) was dissolved in ethanol (125 mL) and Pd/C (0.9 g) added. The nitro group was catalytically reduced under hydrogen 3.65 kg/cm$^2$ (50 psi) for 5 hours. The catalyst was filtered off and the ethanol removed in vacuo. The resulting DMF solution was poured into water (300 mL) and extracted with EtOAc (3×150 mL). The EtOAc extracts were washed well with water to remove traces of DMF, then dried over $MgSO_4$, filtered and reduced to a tan solid 17.3g, (100% crude recovery), suitably pure for further use. MS ES− 596

4-(4,4-Dimethyl-3-oxovaleramido)-3-isopropoxy-(2-(3-tert-butyl-4-acetoxy-phenoxy)-tetradecyl) benzoate A solution of 4-amino-3-isopropoxy-(2-(3-tert-butyl-4-acetoxy-phenoxy)-tetradecyl)benzoate (16.4g, 0.027 mol) and methyl-4,4,-dimethyl-3-oxovalerate (4.33 g, 0.027 mol) in toluene (100 mL) with a catalytic amount of pTSA was heated to reflux. The methanol was driven off and collected by a Dean Stark trap. When the reaction was done, the toluene was reduced to minimum volume, at which point, crystals began to form. The solid was collected and recrystallized from methanol to give a colorless solid, 17.0 g, (87%) of the desired product. MS ES− 722.

4-(4,4-Dimethyl-3-oxo-2-chlorovaleramido)-3-isopropoxy-(2-(3-tert-butyl-4-acetoxy-phenoxy)-tetradecyl)benzoate To a solution of 4-(4,4-dimethyl-3-oxovaleramido)-3-isopropoxy-(2-(3-tert-butyl-4-acetoxy-phenoxy)-tetradecyl) benzoate (7.23 g, 0.01 mol) in dichloromethane (75 mL) was added sulfuryl chloride (1.58 g, 0.01 mol). The mixture was stirred at room temperature for 3 hours. The solvent was removed in vacuo to leave a white waxy solid, 7.5 g, of crude product. The solid was recrystallized from acetonitrile to yield 6.8 g (90%) of the product. MS ES− 757

COUPLER SYNTHESIS FOR Y8

To a solution of 4-(4,4-dimethyl-3-oxo-2-chlorovaleramido)-3-isopropoxy-(2-(3-tert-butyl-4-acetoxy-phenoxy)-tetradecyl)benzoate (6.8 g, 9 mmol) in tetrahydrofuran (50 mL) was added 2-methylsulfonamido-4-methylsulfonyl-phenol (2.63 g, 9.9 mmol) and diisopropylethylamine (1.2g, 0.9 mmol). The reaction mixture was stirred at 50° C. for 3 hours, then submitted to standard aqueous, acidic workup. The crude product was chromatographed on silica gel with dichloromethane/ethyl acetate 95/5 as eluent. The product was recrystallized from methanol to yield a colorless solid in 85% yield. MS ES− 986.

The syntheses of Y15, Y6, Y9, Y10, Y16 and Y5 were as described above for Y4 and Y8, substituting the appropriate alcohol to make the ballast ester group. The synthesis of Y11 was as described for Y4, substituting 4-nitro-3-methoxy-benzoic acid for 4-nitro-3-isopropoxy-benzoic acid.

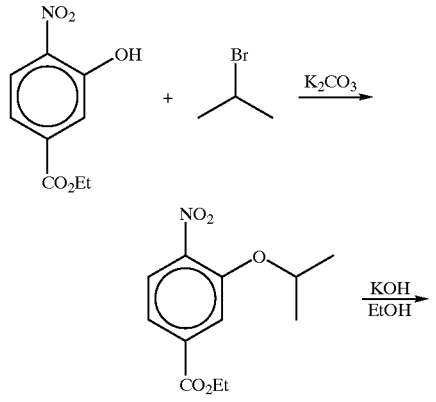

-continued

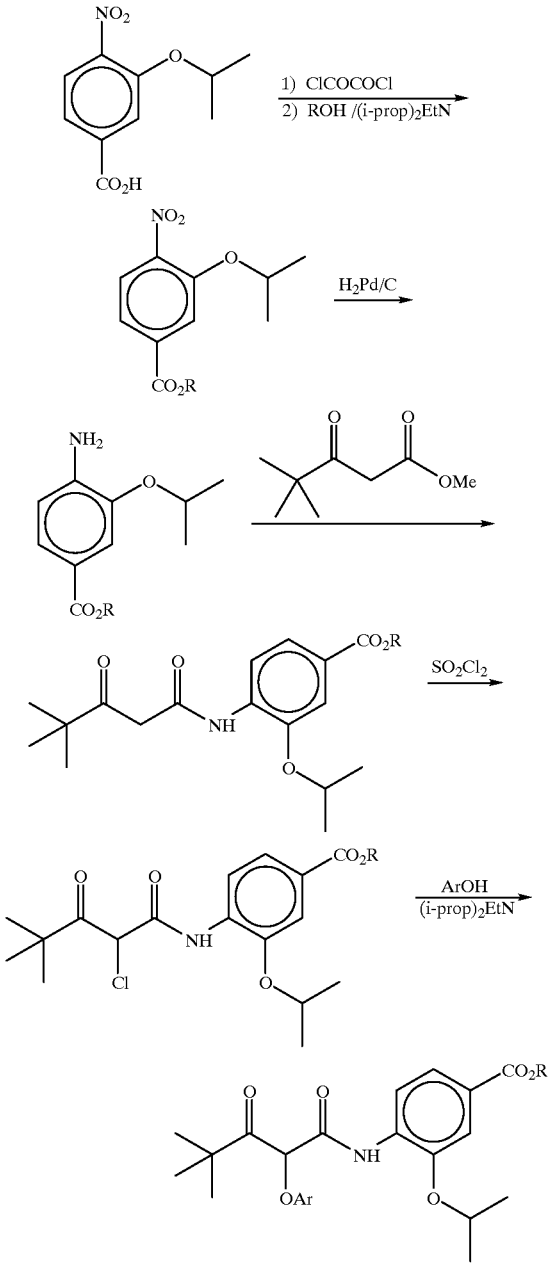

PHOTOGRAPHIC EXAMPLES

Dispersion Preparation

The dispersion for comparison coupler YC1 was prepared by combining a solution containing 2.00 g of coupler with 0.18 g stabilizer ST1, 0.06 g stabilizer ST2, 0.24 g stabilizer ST3, and 1.00 g of tri-butyl citrate at 130° C. with an 80° C. solution containing 2.75 g of decalcified gelatin, 2.75 g of a 10% solution of surfactant Alkanol XC (trademark of E.I. Dupont Co.), and 64.00 g of demineralized water. This combined solution was mixed for one minute at 8000 rpm using a Brinkmann rotor-stator mixer, then homogenized via 2 passes through a Microfluidics Microfluidizer at 3.65 kg/cm$^2$ (8000 psi), 80° C. to produce dispersion 1. This dispersion was then placed in cold storage until ready for combination with a light-sensitive photographic emulsion in a photographic element.

The dispersions for couplers YC2, YC3, Y4, Y5, Y6, YC7, Y8, Y9, and YC 10 were prepared in the same way, except that the stabilizer levels for ST1, ST2 and ST3 were adjusted to allow a constant stabilizer laydown to be achieved when coating couplers of different molecular weight at equimolar laydown.

The dispersions for comparison couplers YC11 and YC12 were prepared by combining a solution containing 0.921 g of coupler with 0.22 g stabilizer ST1, 0.31 g di-butyl-phthalate, 0.26 g 2-(2-butoxyethoxy)ethyl acetate, and 2.76 g ethyl acetate at 60° C. with an 80° C. solution containing 2.44 g decalcified gelatin, 2.44 g of a 10% solution of surfactant Alkanol XC and 34.1 g demineralized water. This combined solution was passed three times through a Gaulin colloid mill, and used in for the coatings in Example 2. The dispersions for comparison coupler YC13 and inventive coupler Y14 were prepared in the same manner using 1.12 g coupler, 0.27 g stabilizer ST1, 0.37 g di-butyl-phthalate, 0.31 g 2-(2-butoxyethoxy)ethyl acetate, and 3.35 g ethyl acetate.

Coating Evaluation

Photographic elements were prepared by using dispersions prepared by the above method coated in the following format on gel-subbed, polyethylene-coated paper support.

EXAMPLE 1

First Layer

An underlayer containing 3.23 g/m$^2$ gelatin.

Second Layer

A photosensitive layer containing (per square meter) 2.15 g of gelatin, an amount of blue-sensitized silver chloride emulsion containing the silver necessary to coat 0.22 g of silver, and an amount of dispersion necessary to coat 0.638×10$^{-3}$ moles of coupler.

Third Layer

A layer containing 1.40 g/m$^2$ gelatin, 0.51 g/m$^2$ UV absorber UV-1, and 0.090 g/m$^2$ of UV absorber UV-2.

Fourth Layer

A protective layer containing 1.08 g/m$^2$ gelatin, 0.18 g/m$^2$ bis(vinylsulfonyl)methane ether, 4.53×10$^{-2}$ g/m$^2$ Alkanol XC, and 4.41×10$^{-3}$ g/m$^2$ tetra-ethylammonium perfluorooctanesulfonate.

The UV stabilizers were as follows:

UV-1

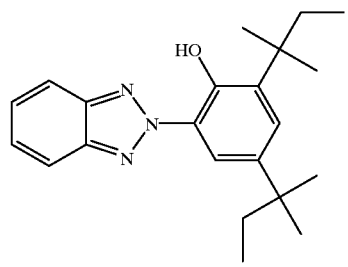

UV-2

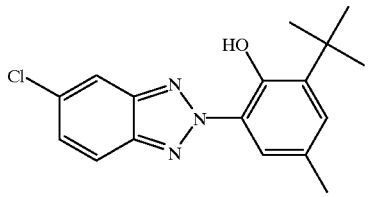

The formulae of the stabilizers were as follows:

ST1

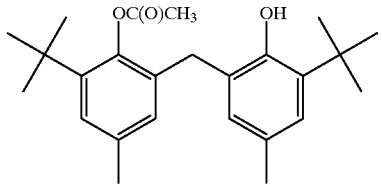

ST2

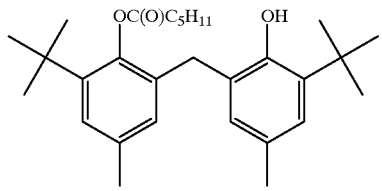

ST3

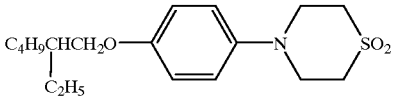

Preparation of Processed Photographic Examples

Processed samples were prepared by exposing the coatings through a step wedge and processing in standard RA-4 chemistry, as described in the British Journal of Photography Annual of 1998, pp 198–199. The "Status A" yellow densities of the processed strips were read and sensitometric curves (density vs. log exposure) were generated. The shoulder density value was calculated by determining the density at 0.4 log E higher exposure than the log E value corresponding to a density of 0.8. For Example 2, contrast was calculated by the formula (S−T)/0.6 where S is the density at a log exposure 0.3 units greater than the exposure required to yield a density of 1.0, and T is the density at a log exposure 0.3 units less than that exposure and maximum density was recorded as D-max. The thermal (dark) stability of each strip was measured after 4 weeks of treatment at 75° C./50% RH (Relative Humidity). The amount of density loss from initial densities of 1.0 and 1.7 was measured and is shown in the tables.

TABLE I

Results for Example 1

| Coupler | Type | 0.4 Shoulder | 4Wk 75° C./50% RH Density Change @ 1.0 | 4Wk 75° C./50% RH Density Change @ 1.7 |
|---|---|---|---|---|
| YC1 | Comp. | 1.71 | −0.01 | −0.05 |
| YC2 | Comp. | 1.86 | −0.01 | −0.05 |
| YC3 | Comp. | 1.80 | −0.08 | −0.14 |
| YC7 | Comp. | 1.63 | −0.12 | −0.12 |
| YC24 | Comp. | 1.90 | −0.11 | −0.18 |
| Y4 | Inv. | 1.90 | −0.04 | −0.09 |
| Y5 | Inv. | 1.98 | −0.04 | −0.09 |
| Y6 | Inv. | 1.94 | −0.03 | −0.08 |
| Y8 | Inv. | 1.97 | −0.04 | −0.09 |
| Y9 | Inv. | 1.86 | −0.05 | −0.11 |
| Y10 | Inv. | 1.80 | −0.04 | −0.12 |

The inventive couplers, which contain the combination of solubilized phenolic coupling off groups with specified 4-position ballast, are showing excellent reactivity as measured by high shoulder values compared to comparison couplers with the solubilized ballast in the 3-position or comparison couplers without a solubilized phenolic coupling off group, or comparison couplers with 4-position ballast without a solubilized phenolic coupling off group. The dark stability performance of the couplers useful in the invention is equivalent to that of couplers with a solubilized phenolic coupling off group in the 3-position. The dark stability is not improved when the ballast is moved from position 3 to position 4 with comparison couplers YC1 and YC2. With a carbonamido para ballast (YC24), the stability is poor.

EXAMPLE 2

First Layer

An underlayer containing 3.23 g/m$^2$ gelatin

Second Layer

A photosensitive layer containing (per square meter) 2.15 g of gelatin, an amount of blue-sensitized silver chloride emulsion containing the silver necessary to coat 0.27 g of silver, and an amount of dispersion necessary to coat $0.851\times10^{-3}$ moles of coupler.

Third Layer

A layer containing 1.40 g/m$^2$ gelatin, 0.14 g/m$^2$ bis (vinylsulfonyl)methane ether, $4.53\times10^{-2}$ g/m$^2$ Alkanol XC, and $4.41\times10^{-3}$ g/m$^2$ tetraethylammonium perfluorooctanesulfonate.

TABLE II

Results for Example 2

| Coupler | Type | Contrast | Dmax | 4Wk 75C/50% RH Density Change @ 1.0 | 4Wk 75C/50% RH Density Change @ 1.7 |
|---|---|---|---|---|---|
| YC11 | Comp. | 2.73 | 2.83 | −0.02 | −0.07 |
| YC12 | Comp. | 2.74 | 2.90 | −0.02 | −0.06 |
| YC13 | Comp. | 2.83 | 2.95 | −0.05 | −0.12 |
| YC23 | Comp | 2.73 | 3.02 | −0.11 | −0.25 |
| Y14 | Inv. | 3.00 | 3.09 | −0.02 | −0.06 |

As in Example 1 the results clearly show that inventive coupler Y14 exhibits high reactivity while providing at least equivalent dark stability shown by comparison couplers. With the carbonamido para ballast, the stability is poor.

The entire contents of the patents and other publications referred to in this specification and in the identified Research Disclosure publications are incorporated herein by reference.

What is claimed is:

1. A color photographic element comprising a yellow dye-forming coupler having formula I:

I

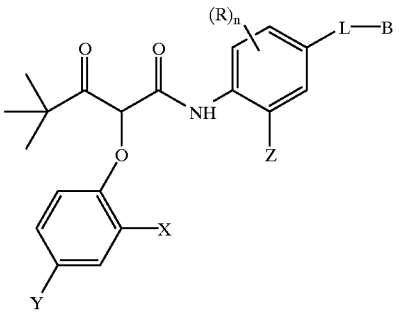

wherein:

B is a substituent containing 6 or more carbon atoms;

L is a linking group bonded to the anilide ring by a carbon, sulfur, or oxygen atom;

R is a substituent and n is 0–3;

X is a solubilizing group containing an acidic proton;

Y is a substituent; and

Z is selected from the group consisting of H, chloro, an alkoxy group and an aryloxy group.

2. The element of claim 1 wherein L is bonded to the anilide ring by a substituent selected from the group consisting of —C(=O)—, —C(=O)O—, —C(=O)N<, —$SO_2$—, —SO—, —$SO_2$N<, and —$SO_2$O—.

3. The element of claim 2 wherein L is bonded to the anilide ring by a substituent selected from the group consisting of —C(=O)—.

4. The element of claim 3 wherein L is bonded to the anilide ring by a substituent selected from the group consisting of —C(=O)—, —C(=O)—O—, and —C(=O)—N<.

5. The element of claim 3 wherein L is bonded to the anilide ring by a —C(=O)—O— group.

6. The element of claim 2 wherein L is bonded to the anilide ring by a substituent selected from the group consisting of —$SO_2$—, —SO—, —$SO_2$N<, and —$SO_2$O—.

7. The element of claim 1 wherein Z is an alkoxy group.

8. The element of claim 5 wherein Z is an alkoxy group.

9. The element of claim 1 wherein Z is a chloro group.

10. The element of claim 5 wherein Z is a chloro group.

11. The element of claim 1 wherein X is selected from the group consisting of carbonamido, sulfonamnido, and carboxylic acid groups.

12. The element of claim 11 wherein X is selected from the group consisting of an alkyl carbonamido, aryl carbonamnido, and a heterocyclic carbonamido compound.

13. The element of claim 11 wherein X is selected from the group consisting of an alkyl sulfonamido, aryl sulfonamido, and a heterocyclic sulfonamido compound.

14. The element of claim 13 wherein X is an alkyl sulfonamido group.

15. The element of claim 1 wherein Y is an electron withdrawing group having a Hammett's sigma para value greater than or equal to 0.

16. The element of claim 15 wherein Y is bonded to the phenyl ring by a substituent selected from the group consisting of —H, —CN, —CON<, —$SO_2$N<, —$SO_2$OH, —$SO_2$—, and —COOH groups.

17. A method of forming an image in the element of claim 1 after imagewise exposure to light, comprising contacting the element with a color developer.

18. A package comprising the element of claim 1 and containing instructions to process using a color print process.

19. The element of claim 1 wherein the element contains a reflective support.

20. The element of claim 1 wherein the element comprises a transparent support.

* * * * *